US010220287B2

(12) United States Patent
Doble et al.

(10) Patent No.: US 10,220,287 B2
(45) **Date of Patent: *Mar. 5, 2019**

(54) GOLF COURSE SAND BUNKER WITH LINER AND METHOD OF MAKING THE SAME

(71) Applicant: BunkersPlus LLC, Henderson, NV (US)

(72) Inventors: Mark Doble, Casa Grande, AZ (US); Eric Doble, Queen Creek, AZ (US); Bryan Doble, Casa Grande, AZ (US); Kip Wolfe, Fountain Hills, AZ (US)

(73) Assignee: Bunkersplus LLC, Henderson, NV (US)

( * ) Notice: Subject to any disclaimer, the term of this patent is extended or adjusted under 35 U.S.C. 154(b) by 3 days.

This patent is subject to a terminal disclaimer.

(21) Appl. No.: 15/723,621

(22) Filed: Oct. 3, 2017

(65) Prior Publication Data

US 2018/0021654 A1 Jan. 25, 2018

Related U.S. Application Data

(63) Continuation-in-part of application No. 14/989,315, filed on Jan. 6, 2016.

(51) Int. Cl.

| | |
|---|---|
| ***A63B 69/36*** | (2006.01) |
| ***E01C 13/02*** | (2006.01) |
| ***E01C 13/06*** | (2006.01) |

(52) U.S. Cl.

CPC ..... *A63B 69/3691* (2013.01); *E01C 13/02* (2013.01); *E01C 13/06* (2013.01); *A63B 2209/00* (2013.01)

(58) Field of Classification Search

None

See application file for complete search history.

(56) References Cited

U.S. PATENT DOCUMENTS 3,383,863 A * 5/1968 Berry ..... E02B 3/126 324/354

3,474,625 A * 10/1969 Draper et al. ..... E02B 3/126 220/62.22

(Continued)

OTHER PUBLICATIONS

The Euclid Chemical Company, PSI Fiberstrand F, Fibrillated Polypropylene Micro-Fiber, Rev. Nov. 2014 www.euclidchemical.com.

(Continued)

*Primary Examiner* — Melba Bumgarner
*Assistant Examiner* — Amir A Klayman
(74) *Attorney, Agent, or Firm* — Caesar Rivise, PC

(57) ABSTRACT

A stabilized course sand bunker and method of making the same is disclosed. The soil making up the bunker is contoured and stabilized so that it is in the form of a pit having a downward angularly extending keyway surrounding the opening at the top edge of the pit. A semi-solid precursor material is applied over the pit and keyway and allowed to cure to form a barrier liner having a flanged anchoring portion for location under some additional soil and turf grass. Bunker sand is disposed over the barrier liner. The barrier liner when cured enables water in the bunker to pass through it, is sufficient flexible to dampen and absorb the impact of a golf ball strike, all the while stabilizing and protecting the edge of the bunker where the turf grass meets the sand in the bunker.

20 Claims, 2 Drawing Sheets

(56) References Cited

U.S. PATENT DOCUMENTS

| | | | | |
|---|---|---|---|---|
| 4,366,846 | A * | 1/1983 | Curati, Jr. | E01B 19/006 141/1 |
| 4,787,776 | A * | 11/1988 | Brady | D06M 15/643 405/270 |
| 5,056,960 | A * | 10/1991 | Marienfeld | B09B 1/00 405/129.6 |
| 5,544,976 | A * | 8/1996 | Marchbanks | B32B 27/12 405/129.6 |
| 5,662,983 | A | 9/1997 | Stark | |
| 5,746,546 | A | 5/1998 | Hubbs et al. | |
| 5,848,856 | A | 12/1998 | Bohnhoff | |
| 6,467,991 | B1 | 10/2002 | Joyce et al. | |
| 6,863,477 | B2 | 3/2005 | Jenkins et al. | |
| 7,207,747 | B1 | 4/2007 | England | |
| 7,344,340 | B2 | 3/2008 | Carlson et al. | |
| 7,699,562 | B2 | 4/2010 | Clark | |
| 8,062,143 | B1 | 11/2011 | Meersman | |
| 8,133,576 | B2 * | 3/2012 | Omori | B23B 27/141 407/113 |
| 8,845,443 | B1 | 9/2014 | Weaver | |
| 2003/0177799 | A1 | 9/2003 | Park et al. | |
| 2004/0156679 | A1 | 8/2004 | Jenkins et al. | |
| 2007/0284302 | A1 | 12/2007 | Blackwood | |
| 2009/0038214 | A1 | 2/2009 | Rozen | |
| 2011/0200401 | A1 | 8/2011 | Lemons | |
| 2013/0116060 | A1 | 5/2013 | Allen | |
| 2013/0184090 | A1 | 7/2013 | Sternberg | |

OTHER PUBLICATIONS

Paragon Building Products, Plastic Cement, Material Safety Data Sheet, (OSHA 29 CFR 1910.1200) Aug. 1, 2009 www.paragonbp.us.

Soil Tech Balancing Construction With Nature, FSB 1000 Formulated Soil Binder, Safety Data Sheet, Aug. 4, 2015.

CTS Cement Manufacturing Corporation, Rapid Set Cement All, Safety Data Sheet, pp. 1-8, Oct. 7, 2014.

Hess Pumice of Idaho, Hess Superior Grade Pumice—All Grades, Safety Data Sheet, pp. 1-3, Jan. 2016.

* cited by examiner

GOLF COURSE SAND BUNKER WITH LINER AND METHOD OF MAKING THE SAME

CROSS-REFERENCE TO RELATED APPLICATIONS

This application constitutes a Continuation-In-Part of our prior application, Ser. No. 14/989,315, filed on Jan. 6, 2016, entitled Golf Bunker Liner, which application is assigned to the same assignee as this invention, and whose disclosure is incorporated by reference herein.

FIELD OF THE INVENTION

This invention relates generally to golf course sand bunkers and more particularly to stabilized golf course sand bunkers making use of barrier liners and methods of stabilizing and lining golf course sand bunkers.

BACKGROUND OF THE INVENTION

As is known golf course sand traps or bunkers are pits filled with sand and surrounded by turf. Such bunkers typically contain approximately 4-6 inches of sand on the bottom of the pit, tapering to a thickness of 2 inches on the sides. Normal usage and the weather tend to cause the sand to slide down of the bunker, particularly if the sidewalls are relatively steep. This action may result in mixing of the sand with subsurface materials. One technique frequently used to prevent the mixing of the sand with substrate materials is to use a geotextile fabric blanket or mat as a bunker liner. In particular, a geotextile blanket or mat is laid in the pit forming the bunker and is stapled to the sidewalls about the perimeter of the pit. The edges of the blanket typically extend under the turf at the perimeter of the bunker.

While the use of such fabrics may impede mixing of the bunker sand with the substrate material and may facilitate drainage, the use of such geotextile blankets is not without its own problems. For example, the installation of such blankets or mats is somewhat expensive and requires a great deal of hand labor to install since they are typically laid in sections and anchored in place with numerous staples. Moreover, the fabric making up such blankets or mats is relatively smooth and when in place does not deter sand from sliding down the bunker's sidewall, particularly when subjected to heavy traffic and/or rainfall. That action may expose the blanket or mat, rendering the bunker unsightly. Even if not exposed, the portions of the blanket or mat located close to where the turf grass meets the edge of the bunker and where the layer of bunker sand is the thinnest, are susceptible to being pulled up and damaged during routine maintenance of the bunker. For example, the exposed portions of the blanket or mat may be snagged during manual or power raking of the bunker sand or on edging of the surrounding turf grass.

Other techniques have been used in the prior art to stabilize the sand within a bunker, such as the use of a layer of gravel or some other particulate material to line the pit forming the bunker, and with an adhesive or some other material sprayed onto the particulate material. See for example, U.S. Pat. No. 8,529,159 (Lemons).

Other prior art systems for lining a golf bunker are found in U.S. Pat. No. 4,960,345 (Hurley et al.); U.S. Pat. No. 5,746,546 (Hubbs et al.): U.S. Pat. No. 5,848,856 (Bohnhoff); U.S. Pat. No. 6,467,991 (Joyce et al.); U.S. Pat. No. 6,863,477 (Jenkins et al.); U.S. Pat. No. 7,207,747 (England); U.S. Pat. No. 7,344,340 (Carlson et al.); U.S. Pat. No. 7,699,562 (Clark); and U.S. 2004/0156679 (Jenkins).

As of the present time no prior art system exists for low cost installation and long term usage in a bunker to maintain the stability of the sand in the bunker, while enabling the safe and easy edging of the turf grass at the border of the bunker, yet which enables water to effectively drain from the bunker, and which is sufficiently flexible to readily absorb impact without damage. The subject invention addresses that need.

SUMMARY OF THE INVENTION

One aspect of this invention is a stabilized golf course bunker having a desired configuration. The bunker is configured to be covered with sand and comprises soil, a surrounding landscape and a barrier liner. The soil and surrounding landscape is in the desired configuration of the bunker having turf, an opening, a top edge, a keyway surrounding the opening at the top edge, an interior surface including sides and a floor formed by compacted soil, and a hinge point located between the key way and the sides. The sides have a downward sloping grade immediately adjacent the hinge point. The key way extends at an acute angle to the grade of the sides. The turf is located above the key way and extends to the hinge point. The barrier liner is formed by a curable semi-solid barrier material applied on the floor, the sides and up and over the top edge for a predetermined distance on the key way and under a portion of the turf surrounding the opening of the bunker. The barrier liner has a thickness at the key way which is greater than a thickness of the barrier liner at the sides. The barrier liner is configured to cure and thereafter be covered with bunker sand to complete the bunker, whereupon the barrier liner enables water to percolate therethrough to reduce water accumulation in the bunker and is sufficiently flexible to dampen or absorb impact when a golf ball hits the bunker.

In accordance with one preferred aspect of the stabilized golf course bunker of this invention the curable semi-solid barrier material comprises a mixture of a dry binding agent, lightweight aggregate and water.

In accordance with another preferred aspect of the stabilized golf course bunker of this invention the barrier liner includes an outer surface at the sides and floor and wherein the barrier liner additionally comprises a thin layer of finishing sand fixedly secured to the outer surface of the barrier liner at the sides and floor.

In accordance with another preferred aspect of the stabilized golf course bunker of this invention bunker sand is disposed over the thin layer of finishing sand.

In accordance with another preferred aspect of the stabilized golf course bunker of this invention the predetermined distance is approximately 4 to 6 inches.

In accordance with another preferred aspect of the stabilized golf course bunker of this invention the thickness of the barrier liner at the key way is in a range of ¾ to 1 inch.

In accordance with another preferred aspect of the stabilized golf course bunker of this invention the thickness of the barrier liner at the sides is in a range of ⅝ to ¾ inch.

In accordance with another preferred aspect of the stabilized golf course bunker of this invention the barrier liner additionally comprising an opening at the floor in fluid communication with a drain pipe.

In accordance with another preferred aspect of the stabilized golf course bunker of this invention the drain pipe is disposed in gravel.

Another aspect of this invention is method of stabilizing and lining a golf course bunker to be covered with sand. The method entails preparing soil of the golf course by forming the soil and surrounding landscape into a desired configuration of a bunker having an opening, a top edge, a lip surrounding the opening, a floor, sides and turf surrounding the opening. The sides have a downward sloping grade. The top edge and the lip surrounding the opening are graded to form a key way surrounding the opening. The key way has a grade extending outward and downward from the opening at an acute angle to the grade of said sides to form a hinge point therebetween. The key way extends underneath a portion of the turf surrounding the opening. The soil is compacted to produce a compacted soil surface. A barrier liner for the bunker is formed by applying a curable semi-solid barrier material on the compacted soil surface of the floor, on the sides, up and over the hinge point, and on the key way. The curable semi-solid material on the key way extends under a portion of the turf surrounding the opening for a predetermined distance outside the hinge point. The barrier liner has a thickness at the key way which is greater than a thickness of the barrier liner at the sides. The barrier liner is allowed to cure, whereupon the cured barrier liner is configured to be covered with sand and which when cured allows water to percolate therethrough to reduce water accumulation in the bunker and is sufficiently flexible to dampen or absorb impact when a golf ball hits the bunker.

In accordance with one preferred aspect of the method of this invention, the barrier liner is cured for 24 hours.

In accordance with another preferred aspect of the method of this invention the curable semi-solid barrier material comprises a mixture of a binding agent, lightweight aggregate and water.

In accordance with another preferred aspect of the method of this invention the thickness of the barrier liner at the key way is in the range of ¾ to 1 inch.

In accordance with another preferred aspect of the method of this invention the thickness of the barrier liner at the sides is in the range of ⅝ to ¾ inch.

In accordance with another preferred aspect of the method of this invention the barrier material is applied by hand.

In accordance with another preferred aspect of the method of this invention the barrier liner includes an outer surface and wherein the method additionally comprises fixedly securing a layer of finishing sand onto the outer surface of the barrier liner to form a finished outer surface for the barrier liner.

In accordance with another preferred aspect of the method of this invention the method additionally comprises applying bunker sand over the finished outer surface.

DETAILED DESCRIPTION OF THE PREFERRED EMBODIMENT

Figure 1:
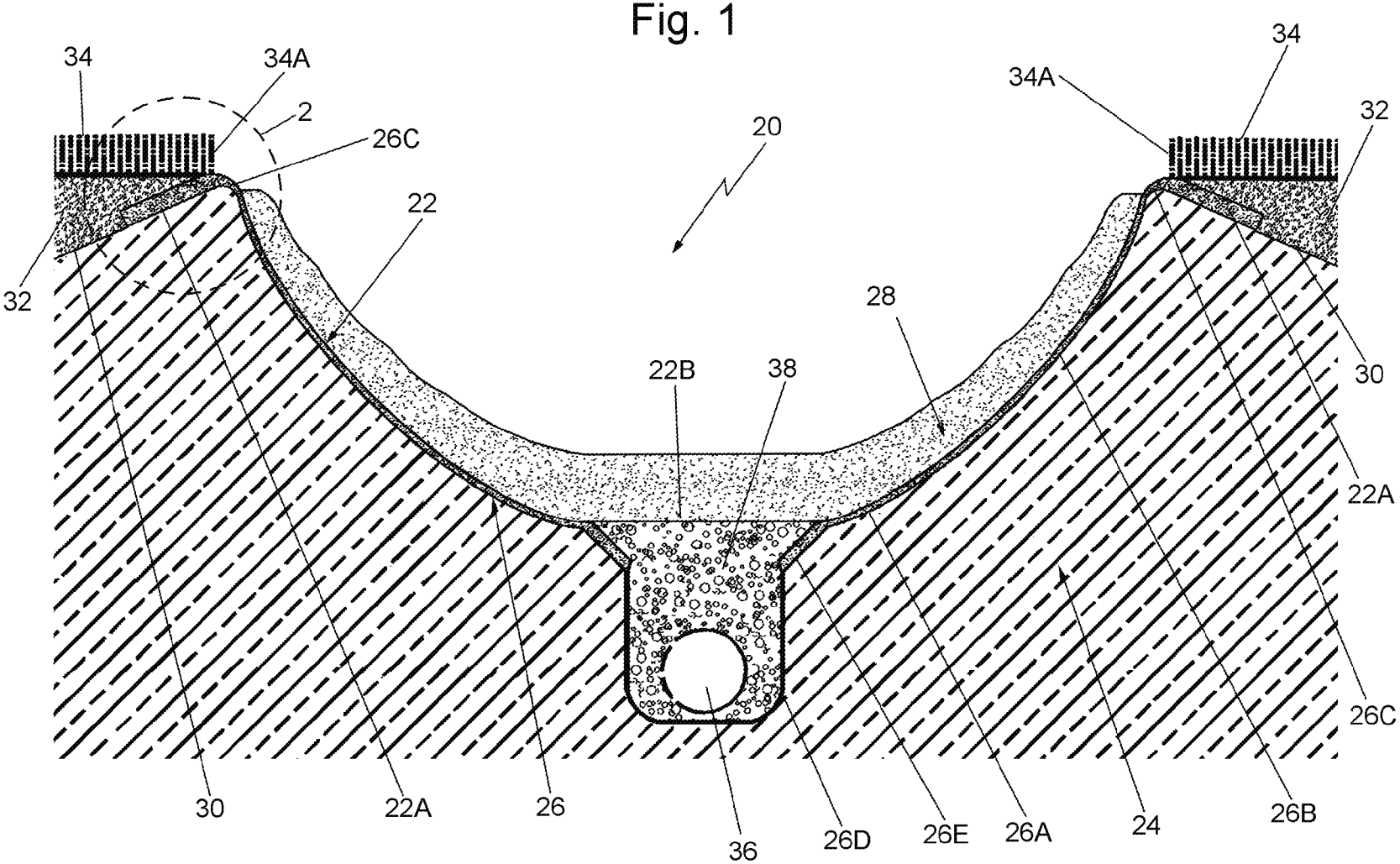
FIG. 1 is a cross sectional view of a sand bunker constructed in accordance with this invention.
Figure 2:
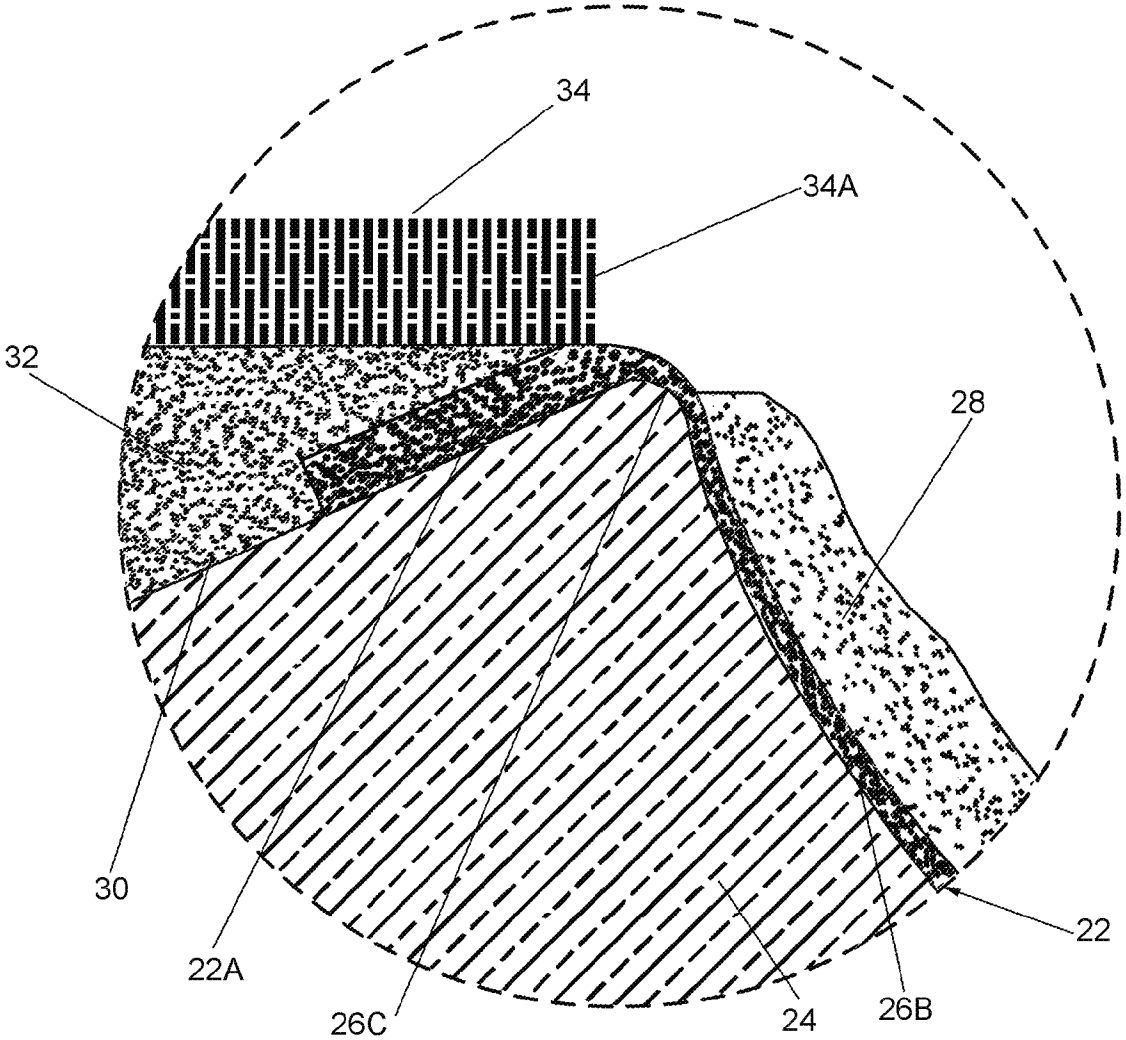
FIG. 2 is an enlarged sectional view of the portion of the sand bunker shown within the circular area designated by the reference number 2 in FIG. 1.

Referring now to the various figures of the drawing wherein like reference characters refer to like parts, there is shown in FIG. 1 one exemplary embodiment of a sand bunker 20 constructed in accordance with this invention. The bunker 20 basically comprises a barrier liner 22 which will be described in detail later and bunker sand 28 disposed over the barrier liner. The barrier liner is formed from a curable semi-solid precursor material that is applied onto compacted soil 24 in which a pit 26 is located and is allowed to cure thereon to form a solid, self-supporting interface which stabilizes the soil and lines the pit. Once the barrier liner 22 has cured conventional bunker sand 28 can be applied onto the outer surface of the barrier liner. The pit 26 can be any shape and size and defines the shape and contour of the bunker 20. Since the material forming the barrier liner 22 is applied as a semi-solid, it can be easily be adapted to the contours and nuances of the cut out bunker pit. Moreover, the material making up the barrier liner when cured is somewhat porous, allowing water to percolate through the barrier liner to reduce water accumulation and to keep the bunker sand in place. Further still, the barrier liner retards weed growth thus reduces use of herbicides or hand weeding. The cured barrier liner is not rigid. Rather it is sufficiently flexible to dampen, or absorb, the impact of a golf ball when a golf ball impacts or hits the sand of the bunker, thereby making for more realistic play.

The precursor material that is used to make the barrier liner 22 is set forth in detail in Table 1 and basically comprises a mixture of a dry binding agent, lightweight aggregate, and water. The resulting precursor material mixture is semi-solid so that it can be readily applied by hand or by machine application, e.g., spray application, and the allowed to cure.

The soil 24 is prepared by forming and compacting the soil and landscape in the configuration and contours of the pit 26 that is desired to stabilize the soil. In particular, as shown clearly in FIG. 1, the pit includes a floor 26A and surrounding sides 26B. The upper edge of the sides 26B is in the form of what can be called a hinge point 26C. The sides have a downwardly sloping grade immediately adjacent the hinge point. The top surface of the soil 24 immediately outside of the hinge point 26C is in the form of a beveled key way 30. The key way 30 projects outward and downward such that the grade of the key way 30 is at an acute angle, e.g., 45 degrees, to the grade of the downwardly sloping sides 26B where the sides merge with the hinge point 26C. The surface of the soil at the key way is also compacted like the soil forming the pit and the hinge point to thereby stabilize the soil of the bunker. The apex of the hinge point forms the top edge or lip of the bunker.

A drainage trench 26D, having a chamfered or beveled entryway 26E is located at the bottom of the pit. A perforated 4" diameter ADS perforated drain pipe 36 is disposed within the trench and surrounded by ⅜" pea gravel 38. The drain pipe 36 serves to drain water, e.g., rain water, from the completed bunker by virtue of the barrier liner directing that water to the drain pipe, as will be described later.

Following the stabilization of the soil 42, as described above, the barrier liner precursor material is mixed to form a curable semi-solid mixture which is then applied by hand or by machine over the surface of the floor, 26A, sidewalls 26B, up and over the hinge point 26 and for a predetermined distance, e.g., 4 inches over the compacted soil at the key way 30. The curable semi-solid material is preferably applied in a thickness range of ⅝ to ¾ inch over the floor, sidewalls and hinge point. The curable semi-solid material that is applied over the key way 30 to form a flanged anchoring portion 22A is thicker, e.g., ¾ to 1 inch, than the thickness of the curable semi-solid material on the floor, sidewalls and hinge point. No curable semi-solid precursor material is applied over the trench holding the drain pipe in the pea gravel, so that there will be a passageway or opening 22B in the floor of the barrier liner communicating with pea gravel the trench 26D. Since the drain pipe is perforated its interior will be in fluid communication with the interstices between the particles of gravel 38

A layer of clean, dry bunker sand is then spread out or sprinkled over the surface of the curable semi-solid material of the barrier liner and then lightly hand troweled to bind the sand to the surface of the curable semi-solid material. Thus, when the curable semi-solid material cures the layer of clean, dry bunker sand is fixedly secured to the outer surface of the barrier liner. This provides a faux "sandy" appearance on the surface of the barrier liner. The semi-solid precursor material with the dry bunker sand thereon is allowed to cure for at least 24 hours, whereupon it becomes a solid self-supporting body, which as mentioned earlier is porous and somewhat flexible.

Regular bunker sand 28 is then applied over the barrier liner 22 and spread out. Then additional soil 32 is filled over the anchoring portion and key way 30 and that additional soil is compacted. Turf grass 34 is then placed over the compacted additional soil 32 so that the inner edge 34A of the turf grass 34 is located immediately adjacent the hinge point 26C, thereby completing the bunker.

As should be appreciated by those skilled in the art, the configuration of the cured barrier liner with the anchoring portion 22A located under the additional soil 34 and the turf grass 34 and with the acute, e.g., 45 degree, angle of the key way at the hinge point allows the hardened barrier liner 22 to anchor and reinforce the opening of the bunker. This action has the effect of reducing any chipping of the bunker by maintenance equipment and precluding the turf grass 34 from growing over the lip of the bunker and into the bunker. In addition, the sand finish on the barrier liner serves to help hold the bunker sand 28 in place. Moreover, in the event that the bunker sand 28 on the sloping sides slides downward, such as could occur in a bunker with steep sloped sides in a heavy rainstorm, the sand of the barrier liner will provide the appearance as if the bunker sand was still in place, thereby maintaining the aesthetics of the bunker until the bunker sand can be replaced on the sloping sides.

As should also be appreciated by those skilled in the art, with the barrier liner 22 in place, water entering the bunker 20 will drain from the bunker by virtue of the water being directed downward by the sloping sides of the barrier liner to the floor of the barrier liner and out through the opening or passageway 22B into the gravel 38 and from there into the drain pipe 36. In addition, some of the water within the bunker will percolate through the porous barrier liner into the underlying soil. Those combined actions result in a bunker that is very efficient in draining water from it.

The curable semi-solid material for forming the barrier liner can take various forms. The specifications for one preferred embodiment are set forth in Table 1 immediately below.

TABLE 1

Preferred Barrier Liner Precursor Material

| Material | General Description | Specific Material | Practical Amount |
|---|---|---|---|
| Cement All | Binding Agent for enhanced set | CTS Cement Manufacturing Corp., Cypress CA. | 0.5-lbs./S.F. |
| Aggregate | 1/8" Pumice Dust | Hess/Pumice/ Idaho USA | 4-lbs./S.F. |

TABLE 1-continued

Preferred Barrier Liner Precursor Material

| Material | General Description | Specific Material | Practical Amount |
|---|---|---|---|
| Water | N/A | N/A | 0.5-0.7 gallons/ S.F |

The ranges for the "practical amount" in the above table represents various expected weather conditions, with the midrange being for normal or typical weather conditions, with lesser amounts to be used in less adverse conditions, and greater amounts to be used in more adverse conditions. Moreover, the above formula provides what is believed to be the best and longest lasting composition. The binding agent serves as a filler and provides some flexibility for the barrier liner after it has cured. The aggregate type has been found to have the best size and bulk density to allow for the most desirable amount of hardness and pliability. The overall mixture when cured allows water to percolate through the barrier liner, making it well suited for long term use, while being sufficiently flexible to readily absorb ball impacts and other physical stresses. In addition, the portion of the barrier liner forming the hinge point will be resistant to damage during maintenance or edging of the turf grass at the bunker.

The binding agent is available from CTS Cement Manufacturing Corporation, 11065 Knott Ave, Suite A, Cypress, Calif. under the product identifier "Rapid Set Cement All", Product codes: 120010055; 120012000; 120013000; 120020010; 120020025; and 120040055.

COMPOSITION/INFORMATION ON INGREDIENTS

| Component | Percent | CAS NO. |
|---|---|---|
| Calcium Sulfoaluminate Cement | 40-60 | 960375-09-1 |
| Silica Sand (Quartz) | 40-60 | 14808-60-7 |
| Sodium Sulfate | 0-4 | 7757-82-6 |
| Methanal | 0.0-0.1 | 50-00-0 |

PHYSICAL AND CHEMICAL PROPERTIES

| | |
|---|---|
| Physical Form: | Powder |
| Color & Odor: | Tan & Low |
| pH: | 11-12 when wet |

One type of pumice aggregate that can be used is that produced by Hess Pumice of Idaho which is amorphous aluminum silicate with a chemical analysis of silicon dioxide 76.2%, aluminum oxide 13.5%, ferric oxide 1.1%, sodium oxide 1.6%, potassium oxide 1.8%, calcium oxide 0.8%, magnesium oxide 0.05%, moisture, less than 1%.

It must be pointed out at this juncture that the precursor materials and method of forming the bunker 20 as described above are merely exemplary. Thus, other precursor materials and methods can be used to form a bunker in accordance with this invention. For example, before the curable semi-solid precursor material to form the barrier liner is applied, and after the soil of the bunker has been compacted a liquid adhesive polymer can be applied to bind the surface of the soil. An alternative curable semi-solid material can then be applied as described above to form the barrier liner 20. After the alternative semi-solid precursor barrier material is allowed to cure for at least 24 hours, another application of adhesive can be sprayed on to the prepared surface and a layer of clean, dry bunker sand applied to form the faux appearance. That alternative semi-solid material precursor material used to make the alternative barrier liner can be like that set forth in Table 2 below.

TABLE 2

Alternative Barrier Liner Precursor Material

| Material | General Description | Specific Material | Practical Amount |
|---|---|---|---|
| Dry Powdered Adhesive | Polymer based gluing agent | Soil Tech/Las Vegas, NV | 2-4 lbs./ S.F. |
| Plastic cement | Binding Agent for enhanced set | Paragon, Phoenix AZ. | 2-4 lbs./ S.F. |
| Fibrillated Fibers | Fiberstrand F Polypropylene micro-fiber | PSI Fibers LaFayette, GA | 1-2 oz./S.F. |
| Aggregate | 1/8" Pumice Dust | Hess/Pumice/ Idaho USA | 4-6 lbs./ S.F. |
| Water | N/A | N/A | .5-.7 gallons/ S.F |

The ranges for the "practical amount" in the above table represents various expected weather conditions, with the midrange being for normal or typical weather conditions, with lesser amounts to be used in less adverse conditions, and greater amounts to be used in more adverse conditions. The plastic cement serves as a filler and provides flexibility of the barrier liner. The aggregate type provides good size and bulk density to allow for a desired amount of hardness and pliability. The overall precursor mixture, like that of the precursor material of Table 1, when cured allows water to percolate through the barrier liner.

The Dry Powdered adhesive which serves as a formulated soil stabilizer is available from Soil Tech, 6420 S. Cameron Drive, Suite 207, Las Vegas, Nev. and has the following characteristics:

FSB-1000 DP (Dispersable Powder)

Dust Palliative, Soil Stabilizer, Slope & Erosion Control

Acrylic Co-Polymer

Soil Tech

6420 S. Cameron Dr., Suite 207

Las Vegas, Nev. 89118

(702)873-2023

COMPOSITION/INFORMATION ON INGREDIENTS

| Component | Percent | CAS NO. |
|---|---|---|
| Acrylic Co-Polymer | 94.0-96. | Non-hazardous |
| Calcium Carbonate | 1-3% | 471-34-1 |
| Water | 0.5-3% | 7732-18-5 |

PHYSICAL AND CHEMICAL PROPERTIES

| | |
|---|---|
| Physical Form: | Powdered solid |
| Color & Odor: | White, acrylic like odor |
| pH: | 7.0-10.0 1% Solution |

Euclid Chemical, 19215 Redwood Road, Cleveland, Ohio, sells one type of a PSI Fiberstrand F, fibrillated polypropylene micro-fiber suitable for use in the present invention with the following characteristics: PSI FIBERSTRAND F is a fibrillated polypropylene micro-fiber to concrete reinforcement that complies with ASTM C 1116, Standard Specification for Fiber Reinforced Concrete and Shotcrete, and is specifically designed to help mitigate the formation of plastic shrinkage cracking in concrete. Typically used at a dosage rate of 1.5 lbs/yd$^3$ (0.9 kg/m$^3$), PSI FIBERSTRAND F micro-fibers have been shown to greatly reduce plastic shrinkage cracking when compared to plain concrete, PSI FIBERSTRAND F micro-fibers also comply with applicable portions of the International Code Council (ICC) Acceptance Criteria AC32 for synthetic fibers:

Typical Engineering Data

| | |
|---|---|
| Material | 100% virgin |
| fibrillated polypropylene | |
| Specific Gravity | 0.91 |
| Typical dosage rate | 1.5 lbs/yd (0.9 kg/m$^3$) |
| Available lengths | ¼" (6 mm), ½" (13 mm), ¾" (19 mm), |
| 1 ½ " (38 mm), 2" (51 mm) and multi-length blend (ML) | 320° F. (160° C.) |
| Melt Point | |
| Electrical and thermal Conductivity | low |
| Water Absorption | negligible |
| Acid and Alkali Resistance | excellent |
| Silicon Dioxide: 76.2% | Chem name: Amorphous Aluminum Silicate |
| Aluminum Oxide: 13.5% | Hardness (MOHS): 6 |
| Ferric Oxide: 1.1% | pH: 7.2 |
| Ferrous Oxide: 0.1% | Radioactivity: None |
| Sodium Oxide: 1.6% | Softening Point: 900 degrees C. |
| Potassium Oxide: 1.8% | Water Soluble substances: 0.15% |
| Calcium Oxide: 0.8% | Reactivity: Inert |
| Titanium Oxide: 0.2% | (except in the presence of calcium hydroxide or hydrofluoric acid) |
| Magnesium Oxide: 05% | Appearance: White powder |
| Moisture: <1.0% | GE Brightness: 84 |

The plastic cement is available from Paragon Building Products, Inc., 2895 Hamner Avenue, Norco, Calif. 92860 and has the following characteristics:

| PRODUCT NAME: PARAGON PLASTIC CEMENT Masonry Cement (CAS # 65997-15-1) | | |
|---|---|---|
| Chemical Family: | FORMULA | CAS# |
| Calcium Salts: | 3CaO•SiO2 | 12168-85-3 |
| | 2CaO•SiO2 | 10034-77-2 |
| | 3CaO•Al2O2 | 12042-78-3 |
| | 4CaO••AlO3Fe2O3 | 12068-35-8 |
| | CaSO2•2H20 | 13397-24-5 |
| Other salts: | Small amount of MgO, and trace amounts of K2SO4•Na2SO4 may also be present | |

The aggregate set forth in Table 2 is a pumice aggregate produced by Hess Pumice of Idaho and is amorphous aluminum silicate with a chemical analysis of silicon dioxide 76.2%, aluminum oxide 13.5%, ferric oxide 1.1%, sodium oxide 1.6%, potassium oxide 1.8%, calcium oxide 0.8%, magnesium oxide 0.05%, moisture, less than 1%.

Without further elaboration the foregoing will so fully illustrate our invention that others may, by applying current or future knowledge, adopt the same for use under various conditions of service.

We claim:

1. A stabilized golf course bunker in a desired configuration, said bunker being configured to be covered with sand and comprising:

soil and a surrounding landscape in said desired configuration of the bunker having turf, an opening, a top edge, an angled keyway surrounding said opening at said top edge, an interior surface including downward sloping sides and a floor formed by compacted soil, and a hinge point located between said angled key way and said downward sloping sides, said turf surrounding said opening, said angled key way having a grade extending outward and downward from said opening, said angled key way extending underneath a portion of said turf surrounding said opening, said downward sloping sides having a downward sloping grade immediately adjacent said hinge point, said key way extending at an acute angle to said downward sloping grade of said sides inside said bunker, said turf being located above said angled key way and extending to said hinge point; and a barrier liner formed by a curable semi-solid barrier material applied on said floor, and with a portion of said barrier liner on said downwardly sloping sides, said portion of said barrier liner on said downwardly sloping sides having a thickness, said barrier liner also including a portion extending up and over said top edge for a predetermined distance on said angled key way and under a portion of said turf surrounding said opening of said bunker to include said hinge point between said top edge and said angled key way, said portion of said barrier liner overlying said angled key way having a thickness which is greater than the thickness of said barrier liner on said downwardly sloping sides, said barrier liner being configured to cure and thereafter be covered with bunker sand to complete said bunker, whereupon said barrier liner enables water to percolate therethrough to reduce water accumulation in said bunker and is sufficiently flexible to dampen or absorb impact when a golf ball hits said bunker.

2. The stabilized golf course bunker of claim 1, wherein said curable semi-solid barrier material comprises a mixture of a dry binding agent, lightweight aggregate and water.

3. The stabilized golf course bunker of claim 1, wherein said barrier liner includes an outer surface at said sides and floor and wherein said barrier liner additionally comprises a thin layer of finishing sand fixedly secured to said outer surface of said barrier liner at said sides and floor.

4. The stabilized golf course bunker of claim 3, additionally comprising loose bunker sand disposed over said thin layer of fixedly secured finishing sand.

5. The stabilized golf course bunker of claim 1, wherein said predetermined distance is approximately 4 to 6 inches.

6. The stabilized golf course bunker of claim 1, wherein said thickness of said barrier liner at said key way is in a range of ¾ to 1 inch.

7. The stabilized golf course bunker of claim 1, wherein said thickness of said barrier liner at said sides is in a range of ⅝ to ¾ inch.

8. The stabilized golf course bunker of claim 1, wherein said thickness of said barrier liner at said sides is in a range of ⅝ to ¾ inch.

9. The stabilized golf course bunker of claim 1, additionally comprising an opening at said floor in fluid communication with a drain pipe.

10. The stabilized golf course bunker of claim 9, wherein said drain pipe is disposed in gravel.

11. A method of stabilizing and lining a golf course bunker to be covered with sand comprising the steps of:

a. preparing soil of the golf course by forming said soil and surrounding landscape into a desired configuration of a bunker having an opening, a top edge, a lip surrounding said opening, a floor, downwardly sloping sides and turf surrounding said opening, said downwardly sloping sides having a downward sloping grade;

b. grading said top edge and said lip surrounding said opening to form an angled key way surrounding said opening, said angled key way having a grade extending outward and downward from said opening at an acute angle to form a hinge point between said angled key way and said downwardly sloping sides extending underneath a portion of said turf surrounding said opening;

c. compacting said soil to produce a compacted soil surface;

d. forming a barrier liner for said bunker by applying a portion of curable semi-solid barrier material on said compacted soil surface of said floor, by applying a portion of said curable semi-solid material on said downwardly sloping sides, up and over said hinge point, and on said angled key way, said portion of said curable semi-solid material on said downwardly sloping sides having a thickness, said portion of said curable semi-solid material on said angled key way extending under a portion of said turf surrounding said opening for a predetermined distance outside said hinge point, said portion of said semi-curable barrier material on said angled key way having a thickness which is greater than the thickness of said curable semi-solid material on said downwardly sloping sides; and e. allowing said curable semi-solid barrier material to cure to form a cured barrier liner, whereupon said cured barrier liner is configured to be covered with sand and which allows water to percolate therethrough to reduce water accumulation in said bunker and is sufficiently flexible to dampen or absorb impact when a golf ball hits said bunker.

12. The method of claim 11, wherein said barrier liner is cured for 24 hours.

13. The method of claim 11, wherein said curable semi-solid barrier material comprises a mixture of a dry binding agent, lightweight aggregate and water.

14. The method of claim 11, said predetermined distance is approximately 4 to 6 inches.

15. The method of claim 11, wherein said thickness of said barrier liner at said key way being in the range of ¾ to 1 inch.

16. The method of claim 11, wherein said thickness of said barrier liner at said sides being in the range of ⅝ to ¾ inch.

17. The method of claim 15, wherein said thickness of said barrier liner at said sides being in the range of ⅝ to ¾ inches.

18. The method of claim 11, wherein said barrier material is applied by hand.

19. The method of claim 11, wherein said barrier liner includes an outer surface and wherein said method additionally comprises fixedly securing a layer of finishing sand onto said outer surface of said barrier liner to form a finished outer surface for said barrier liner.

20. The method of claim 19, additionally comprising applying loose bunker sand over said thin layer of fixedly secured finishing sand.

* * * * *